US006691692B1

(12) United States Patent
Adkins

(10) Patent No.: US 6,691,692 B1
(45) Date of Patent: Feb. 17, 2004

(54) ADJUSTABLE CAM FOR ARCHERY BOWS

(76) Inventor: Daniel K. Adkins, 13716 Carmenita Rd., Santa Fe Springs, CA (US) 90670

( * ) Notice: Subject to any disclaimer, the term of this patent is extended or adjusted under 35 U.S.C. 154(b) by 0 days.

(21) Appl. No.: 10/233,393

(22) Filed: Sep. 3, 2002

(51) Int. Cl.[7] ..... F41B 5/10
(52) U.S. Cl. ..... 124/25.6; 124/900
(58) Field of Search ..... 124/25.6, 900

(56) References Cited

U.S. PATENT DOCUMENTS 4,774,927 A * 10/1988 Larson
4,967,721 A * 11/1990 Larson
5,881,705 A * 3/1999 Howell et al.
5,960,778 A * 10/1999 Larson ..... 124/25.6
6,250,293 B1 6/2001 Andrews
6,360,735 B1 * 3/2002 Larson et al. ..... 124/25.6

* cited by examiner

*Primary Examiner*—John A. Ricci
(74) *Attorney, Agent, or Firm*—Edgar W. Averill, Jr.

(57) ABSTRACT

An adjustable cam for an archery bow. The adjustable cam is located at the end of one of the bow limbs. The other bow limb has an idler cam located at its end. The bowstring has a bowstring end attached to the adjustable cam. The bowstring passes over the idler cam and the second or end stretch end of the bowstring is also attached to the adjustable cam. A harness string has one end attached adjacent the idler cam and the other end attached to the adjustable cam. An intermediate portion of the adjustable cam may be adjusted to set the draw length of the bowstring. A draw stop or fine draw length adjustment is also provided on the adjustable cam.

14 Claims, 3 Drawing Sheets

ADJUSTABLE CAM FOR ARCHERY BOWS

BACKGROUND OF THE INVENTION

The field of the invention is sporting goods and the invention relates more particularly to compound archery bows. Compound archery bows have greatly facilitated the use of bows and permit the archer to pull back on the bowstring with increasing force to a let off point where the amount of force required to further withdraw the bowstring greatly deceases, which permits the archer to hold the bow in a fully drawn position with far less effort as compared to bows made before the development of the compound bow. The distance that an archer pulls back the bowstring before it stops or reaches the wall is the "draw Length."

Compound bows are discussed in detail in U.S. Pat. No. 6,250,293 and the specification and drawings of that patent are incorporated herein by reference for background purposes. It is often desired that the draw length be adjusted by the archer. Early designs of cams required that the bow be disassembled to change the draw length, which required a bow press. This prohibited the archer from changing the draw length in the field. Designs have been devised which permitted draw length adjustment without a bow press, but such designs required the removal of screws which could be easily dropped during an adjustment and the inability to find a screw if no replacement screw is available would disable the bow.

Draw stops are also provided so that once the bowstring is fully drawn, the further amount that the bowstring may be drawn is stopped by the draw stop. The adjustment of the draw stop is a highly useful feature since it provides a fine adjustment of the draw length.

BRIEF SUMMARY OF THE INVENTION

It is an object of the present invention to provide an improved adjustable cam for archery bows which permit the adjustment of the draw length without the use of a bow press or the removal of one or more screws. The present invention is for an adjustable cam for an archery bow having a pair of limbs having an idler rotatingly secured at an end of an idler limb and an adjustable cam rotatingly secured at the end of the other limb. The archery bow has a bow string attached to the adjustable cam at a bow string cam end. The bowstring extends around the idler wheel and has a returning end stretch. The end stretch has an end which is also affixed to the adjustable cam. A harness string is affixed at an idler end to the idler limb and to the adjustable cam at its other end. The adjustable cam thus has three tracks comprising a bowstring or inner track, a harness or intermediate track, and an end stretch or outer track. The improvement of the present invention comprises the bowstring or inner track being formed on an inner cam body. The harness or intermediate track is formed on an intermediate cam body. The end stretch or outer track is formed on an outer cam body. The intermediate cam body is fabricated from a separate member from either of the inner or outer cam bodies. The intermediate cam body has a curved adjustment slot which captures an adjustment member which is configured to tighten the intermediate cam body against the inner cam body in order to adjust the draw length. The intermediate cam body preferably has a second curved adjustment slot which captures a second adjustment member, also configured to tighten the intermediate cam body against the inner cam body. The intermediate cam body preferably has a harness string stop slot at an end of the intermediate cam body positioned so that it captures the harness string as the bowstring is withdrawn to a fully drawn position and functions as a wall. Preferably, the harness string stop slot is adjustable by the use of a draw stop screw within the draw slot. Also preferably, the draw slot has a window along its side so that the position of the draw stop screw can be viewed by the archer.

DESCRIPTION OF THE PREFERRED EMBODIMENTS

Figure 1:
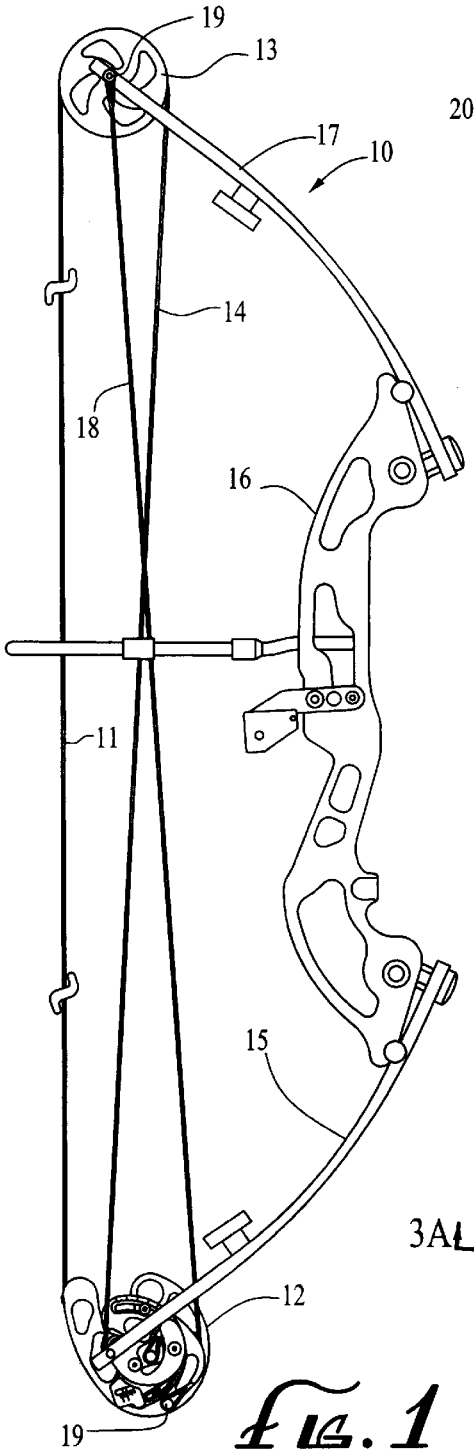
FIG. 1 is a side view of a bow having the adjustable cam of the present invention thereon.

A compound bow is shown in FIG. 1 and indicated generally by reference character 10. Compound bow 10 has a bowstring 11 which is affixed to an adjustable cam indicated generally by reference character 12 at one end of the bowstring. Bowstring 11 loops over an idler cam 13. Bowstring 11 has an end stretch portion 14 which extends back to adjustable cam 12 to which its end is affixed. Adjustable cam 12 is attached near the end of lower limb 15. Lower limb 15 is attached to a handle 16 which, in turn, supports upper limb 17.

A harness string 18 has an idler end 19 which is split and affixed on both sides of idler cam 13. Harness string 18 is affixed to adjustable cam by hookup post 19.

Figure 3:
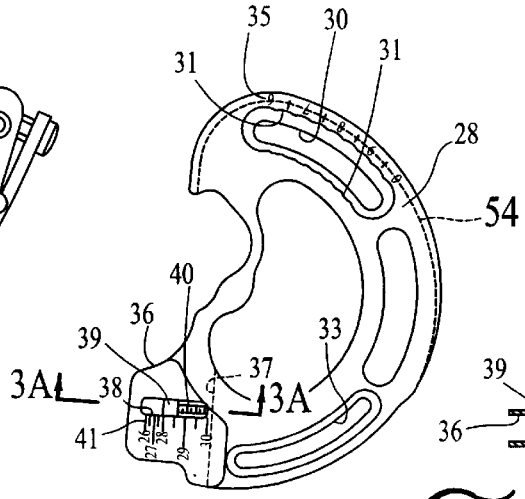
FIG. 3 is a front view of the intermediate cam body of the adjustable cam of the present invention.
Figure 3A:
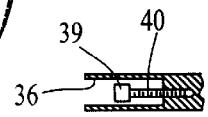
FIG. 3A is a cross-sectional view taken along line 3A—3A of FIG. 3.
Figure 4:
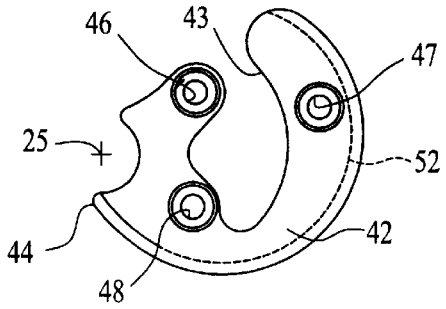
FIG. 4 is a front view of the outer cam body of the adjustable cam of the present invention.
Figure 5:
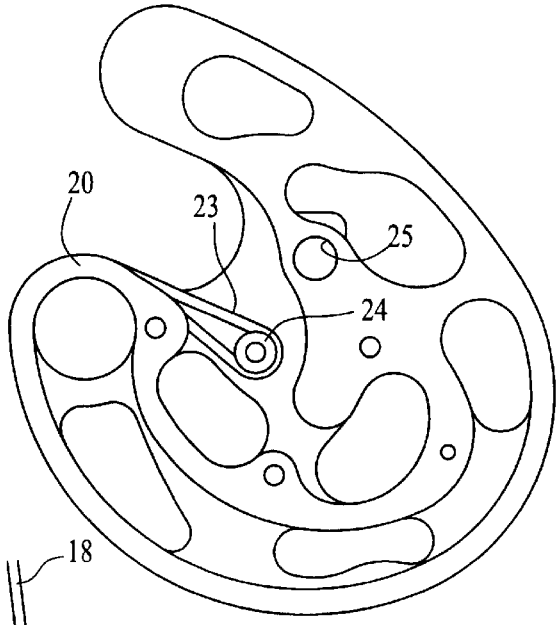
FIG. 5 is a back view of the inner cam portion of FIG. 2.

The details of construction of the adjustable cam are shown in FIGS. 2 through 6. The views shown in FIGS. 2, 3, 4, and 6 will be referred to as the front views of the adjustable cam and FIG. 5 shows the back view of the adjustable cam.

Figure 2:
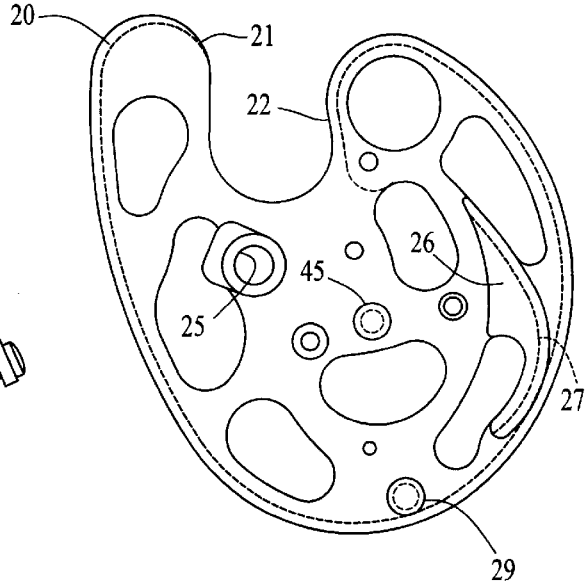
FIG. 2 is a front view of the inner cam body of the adjustable cam of the present invention.

FIG. 2 is a front view of the inner cam portion 20 which has an outer peripheral bowstring groove extending from reference character 21 to reference character 22. The end of the bowstring 23 is formed in a loop and passes over hookup post 24 shown in FIG. 5 on the back of inner cam portion 20.

The inner cam portion 20 rotates about its axis 25 which is rotatingly secured near the end of lower limb 15 shown in FIG. 1. Inner cam portion 20 supports an intermediate cam segment 26 which has a groove 27 on its outer edge which cooperates with the groove on the intermediate cam portion discussed below.

Intermediate cam portion 28 is shown in FIG. 3 and is secured to the surface of inner cam portion 20, which is shown in FIG. 2. The securement of intermediate cam portion is accomplished in a manner shown in FIG. 6 of the drawings. Intermediate cam portion 28 guides the harness string 18, which is secured by an end loop to harness string hookup post 29 shown in FIG. 2, and formed on the inner surface of inner cam portion 20, after harness string has passed along 27, also shown in FIG. 2. Returning to FIG. 3, intermediate cam portion 28 has a curved adjustment slot 30. Slot 30 preferably has a plurality of grooves 31 which abut the underside of a tapered screw head shown in FIG. 6. This combination of grooves and the tapered screw head cause the intermediate cam portion to be adjustable in a plurality of distinct positions. Nine distinct positions have been successfully utilized.

A second curved slot 33 is also formed through intermediate cam portion 28 to provide a second point of positioning for intermediate cam portion 28 on inner cam portion 20. Slot 33 is stepped so that a screw abuts an inner flange to permit the tightening so that a screw 34 may guide the movement of cam portion 28. The stop permits tightening the intermediate cam portion 28 against inner cam portion 20. Preferably, indicia 35 are provided adjacent curved adjustment slot 30 so that the user can take note of any desired position. Once the tapered screw head 32 is placed in one of the grooves 31, the position of screw 34 is fixed, and thus, there is no need for any indicia adjacent curved slot 33.

As the bowstring 11 is drawn, the adjustable cam 12 rotates in a clockwise direction as viewed in FIG. 1 to an extent where a draw stop slot 36 captures harness string 18. This prevents the further rotation of adjustable cam 12, thereby providing a stop or wall preventing any further withdrawal of bowstring 11.

Draw stop slot 36 is formed into intermediate cam portion 28 to a depth shown by the dotted line indicated by reference character 37 in FIG. 3. A window 38 is formed in the side of slot 36 so that the archer can view the position of a screw head 39, which is part of a screw 40 threaded into the bottom of slot 36. Screw head 39 acts as a stop and abuts harness string 18 to provide a wall against further withdrawal of the bowstring. Indicia 41 may also be provided adjacent screw head 39 so that the archer can make the adjustment to a known position. Screw 40 is an Allen screw and may be adjusted by the use of an Allen wrench.

Figure 6:
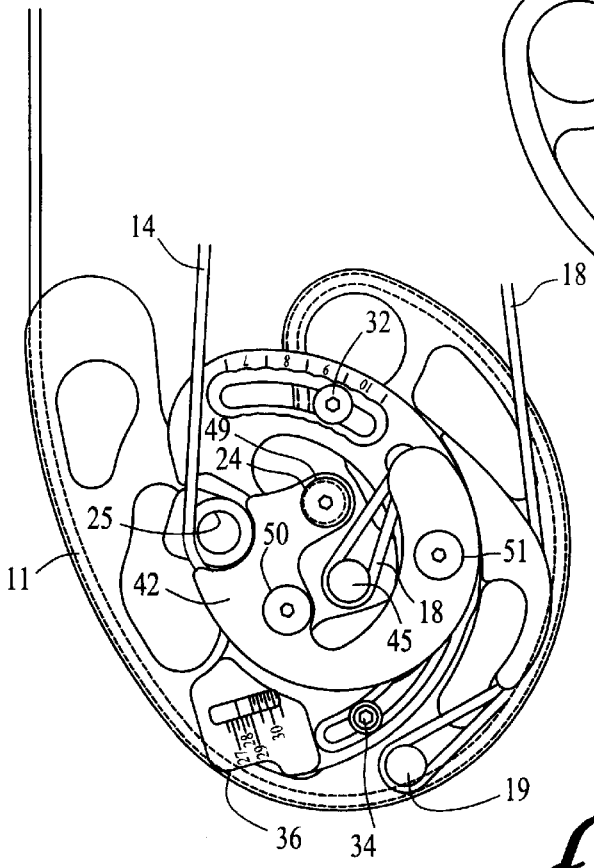
FIG. 6 is a front view of the inner, intermediate, and upper cam portions of the adjustable cam of the present invention.

The outer cam body is shown in FIG. 4 and indicated by reference character 42. Outer cam body 42 has an end stretch hook up post 45. Cam body 42 has an end stretch groove 52 extending from reference character 43 to reference character 44 in FIG. 4. Outer cam body 42 has three screw hole openings 46, 47, and 48 which support three screws 49, 50, and 51. Screws 49, 50, and 51 thread into threaded openings in inner cam portion 20 and cause outer cam body 42 to sandwich intermediate cam portion 28 against inner cam portion 20. As shown in FIG. 6, end stretch 14 passes around outer cam body 42 and is held by end stretch hookup post 45.

Figure 7:
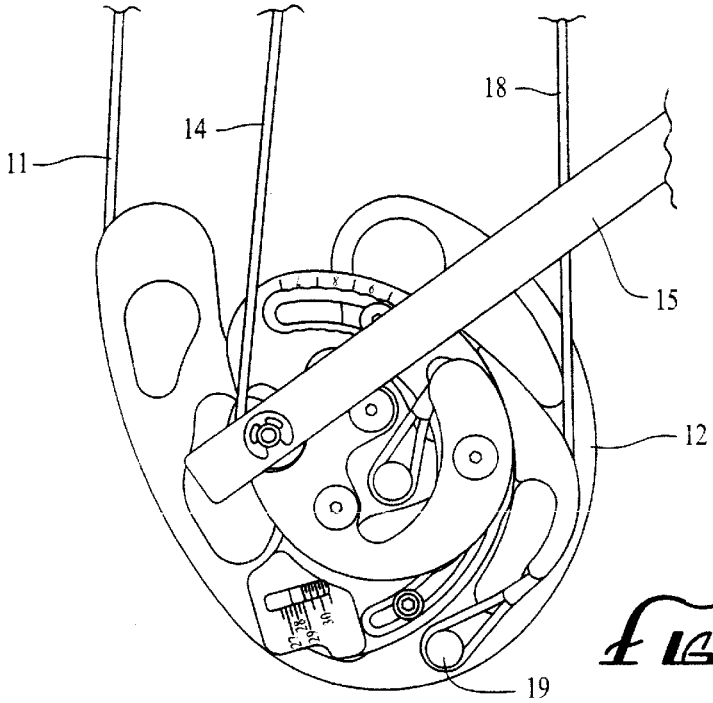
FIG. 7 is a front view of the adjustable cam of FIG. 6 with the bowstring in an at-rest position.
Figure 8:
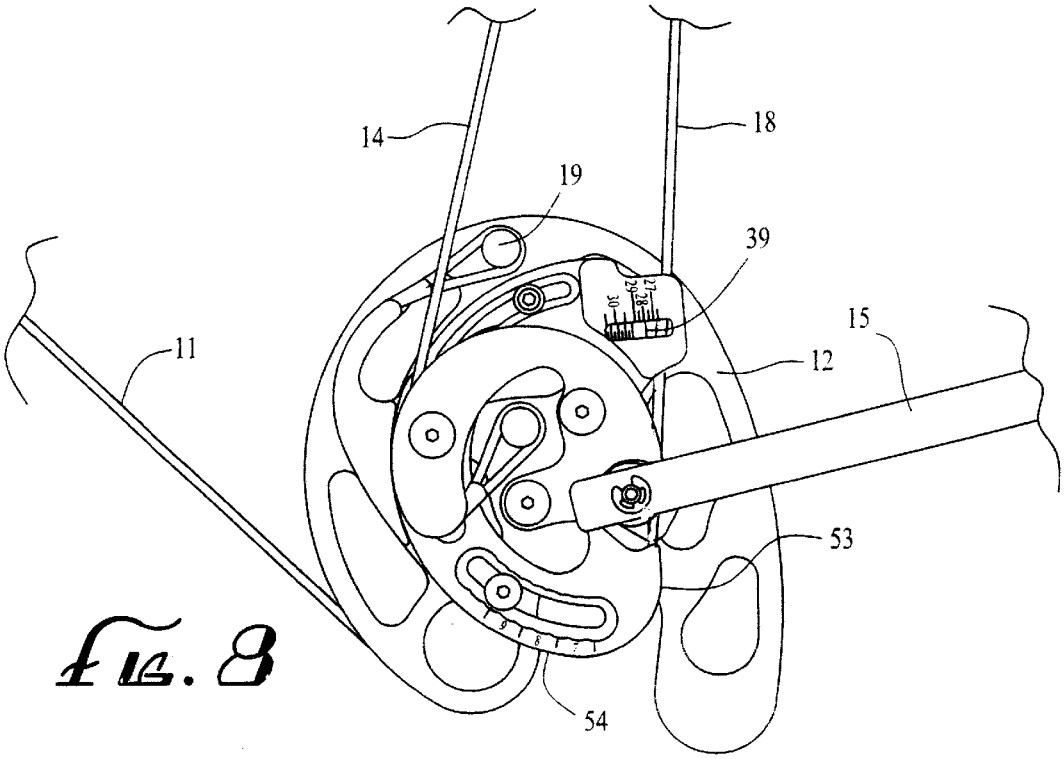
FIG. 8 is a front view of the adjustable cam of FIG. 6 showing a bowstring in the fully drawn position.

The adjustable cam is shown in FIG. 7 in an at-rest configuration. As bowstring 11 is pulled, it moves adjustable cam 12 to the position shown in FIG. 8. Two things have happened as the cam reaches the position of FIG. 8. Firstly, just before the fully withdrawn configuration, the harness string 18 reaches point 53 of intermediate cam portion 28. At this point, the rate at which harness string 18 is withdrawn with each degree of turn of adjustable cam 12 abruptly reduces due to the sharp change in curvature of harness groove 54. This reduction in the pull on the bowstring is referred to as "let off" and is expressed as a percentage or reduction of draw weight, such as 65%. This makes it much easier for the archer to hold the bow in a fully drawn position.

The intermediate cam portion 28 is adjustable through an arc of about 45 degrees, which provides in an exemplary bow, a change in draw length from 32 inches to 36 inches. The change in draw length for adjacent adjustment slots 30 is about one full half inch.

The second occurrence is the abutment of screw head 39 with harness string 18. This stops the further rotation of adjustable cam 12 and provides a wall or stop of further withdrawal.

The adjustment of draw length is accomplished by changing the position of intermediate cam portion 28 within adjustable cam 12. This, in turn, is carried out by loosening screws 49, 50, and 51 slightly, without removing any screws. Next, tapered screw head 32 is loosened, as is screw 34. Then tapered screw head 32 is placed in a different groove 31. As the intermediate cam portion 28 is rotated clockwise as viewed in FIG. 6, the draw length is reduced. Conversely, as the intermediate cam portion 28 is turned counter clockwise the draw length is increased as is the let off. With the adjustable cam of the present invention, these adjustments can be readily made without the use of a bow press and the removal of any screws, greatly facilitating this adjustment.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. An adjustable cam for an archery bow having a pair of limbs having an idler wheel rotatingly secured at an end of an idler limb and the adjustable cam rotatingly secured at the end of the other limb being a cam limb, the archery bow having a bowstring attached to the adjustable cam at a bowstring cam end, said bowstring extending around the idler wheel and said bowstring having a returning end stretch attached at an end stretch end to the adjustable cam and said archery bow having a harness string attached at an idler end to the idler limb near an end thereof and attached at a harness string cam end to said adjustable cam said adjustable cam having three tracks comprising a bowstring or inner track, a harness or intermediate track, and an end stretch or outer track wherein the improvement comprises:

said bowstring or inner track being formed on an inner cam body, said harness or intermediate track being formed on an intermediate cam body, and said end stretch or outer track being formed on an outer cam body and said intermediate cam body being fabricated from a separate member from either of said inner or outer cam body and said intermediate cam body being movably adjustable with respect to said inner and outer cam bodies, said intermediate cam body having a curved adjustment slot which captures an adjustment member which is configured to tighten said intermediate cam body against said inner cam body in order to adjust the draw length of the bowstring.

2. The adjustable cam of claim 1 wherein said adjustment member is an adjustment screw with a tapered head and said arcuate adjustment slot has a plurality of tapered grooves which mate with said tapered head thereby providing a plurality of stable securement positions for said adjustment screw.

3. The adjustable cam of claim 1 wherein said intermediate cam body has a second curved adjustment slot which captures a second adjustment member which is configured to tighten said intermediate cam body against said inner cam body adjacent said second curved adjustment slot.

4. The adjustable cam of claim 1 wherein said inner, intermediate and outer cam bodies are separate members.

5. The adjustable cam of claim 4 wherein said outer cam body may be tightened toward said inner cam body capturing said intermediate cam body there between.

6. The adjustable cam of claim 1 wherein said intermediate cam body may be adjusted through an arc of about 45 degrees.

7. The adjustable cam of claim 6 wherein said adjustable harness string stop member is an adjustment screw having a head which contacts said harness string.

8. The adjustable cam of claim 7 wherein said harness string stop slot has a window formed along a side thereof along a line of travel of said stop adjustment screw whereby the position of the head of the stop adjustment screw can be viewed.

9. The adjustable cam of claim 1 wherein said intermediate cam body has a harness string stop slot at an end of said intermediate cam body positioned so that it captures said harness string as the bowstring is withdrawn to a fully drawn position and functions as a wall adjustment.

10. The adjustable cam of claim 9 wherein said harness string stop slot contains an adjustable harness string stop member.

11. An adjustable cam for an archery bow having a pair of limbs having an idler wheel rotatingly secured at an end of an idler limb and the adjustable cam rotatingly secured at the end of the other limb being a cam limb, the archery bow having a bowstring attached to the adjustable cam at a bowstring cam end, said bowstring extending around the idler wheel and said bowstring having a returning end stretch attached at an end stretch end to the adjustable cam and said archery bow having a harness string attached at an idler end to the idler limb near an end thereof and attached at a harness string cam end to said adjustable cam said adjustable cam having three tracks comprising a bowstring or inner track, a harness or intermediate track, and an end stretch or outer track wherein the improvement comprises:

said bowstring or inner track being formed on an inner cam body, said harness or intermediate track being formed on an intermediate cam body, and said end stretch or outer track being formed on an outer cam body and said inner, intermediate, and outer cam bodies being fabricated from separate members and said intermediate cam body being movably adjustable with respect to said inner and outer cam bodies, said intermediate cam body having a first and a second curved adjustment slot each of which captures an adjustment member which is configured to tighten said intermediate cam body against said inner cam body and said intermediate cam body has a harness string stop slot at an end of said intermediate cam body positioned so that it captures said harness string as the bowstring is withdrawn to a fully drawn position.

12. The adjustable cam of claim 11 wherein said first curved adjustment slot has position indicia positioned along an outer edge thereof.

13. The adjustable cam of claim 11 wherein said harness string stop slot has a viewing window formed along one side thereof.

14. The adjustable cam of claim 13 wherein said viewing window has indicia positioned along one side thereof.

* * * * *